US007576481B2

(12) United States Patent
Lemaitre

(10) Patent No.: US 7,576,481 B2
(45) Date of Patent: Aug. 18, 2009

(54) HIGH VOLTAGE STABLE CATHODE FOR X-RAY TUBE

(75) Inventor: Sergio Lemaitre, Whitefish Bay, WI (US)

(73) Assignee: General Electric Co., Schenectady, NY (US)

( * ) Notice: Subject to any disclaimer, the term of this patent is extended or adjusted under 35 U.S.C. 154(b) by 379 days.

(21) Appl. No.: 11/160,623

(22) Filed: Jun. 30, 2005

(65) Prior Publication Data

US 2007/0003018 A1 Jan. 4, 2007

(51) Int. Cl.
*H01J 19/42* (2006.01)

(52) U.S. Cl. ..... 313/356; 313/292; 313/352; 313/446; 313/353; 313/331; 378/136; 378/137; 378/138; 378/113; 378/178

(58) Field of Classification Search ..... 313/146, 313/310, 332–334, 346 R, 352–356, 445–451, 313/326, 309, 331, 302, 270, 292, 422, 37, 313/56, 346; 378/121, 122, 135, 130, 178, 378/142, 141, 114, 145, 125, 113, 119, 134, 378/140, 136–138
See application file for complete search history.

(56) References Cited

U.S. PATENT DOCUMENTS 4,673,842 A * 6/1987 Grieger et al. ..... 313/292
4,685,118 A * 8/1987 Furbee et al. ..... 378/114
4,823,371 A * 4/1989 Grady ..... 378/134
4,894,853 A * 1/1990 Dowd ..... 378/138
5,515,413 A 5/1996 Knudsen
5,623,530 A * 4/1997 Lu et al. ..... 378/136
6,373,922 B1 4/2002 Dalpe
6,419,758 B1 7/2002 Bewlay
6,760,407 B2 7/2004 Price
6,762,540 B2 7/2004 Schaefer
6,785,359 B2 8/2004 Lemaitre
2002/0187711 A1* 12/2002 Kautz et al. ..... 445/28
2004/0022361 A1* 2/2004 Lemaitre ..... 378/138

* cited by examiner

*Primary Examiner*—Joseph L Williams
*Assistant Examiner*—Fatima N Farokhrooz

(57) ABSTRACT

A method of producing a cathode for use in an x-ray tube assembly is provided including machining an emission aperture into a cup emission surface portion of a cup structure. The cup structure is comprised of a cup base portion opposite the cup emissions surface portion. Electro-discharge machining is used to form an electro-discharge machining slot into the cup structure to provide access to the interior of the cup structure. Electro-discharge machining is used to form a transverse coil chamber within the interior by way of the electro-discharge machining slot such that the transverse coil chamber is formed between the cup base portion and the cup emissions surface portion while retaining an essentially contiguous emissions surface perimeter surrounding the emission aperture.

7 Claims, 2 Drawing Sheets

HIGH VOLTAGE STABLE CATHODE FOR X-RAY TUBE

TECHNICAL FIELD

The present invention relates generally to a cathode for use in an x-ray tube assembly and more particularly to a method for electro-discharge machining a cathode for use in an x-ray tube assembly.

BACKGROUND OF THE INVENTION

Existing medical x-ray tube assemblies include a cathode assembly having an emitter and a cup. The cathode assembly is orientated to face an x-ray tube anode, or target, which is typically a planar metal or composite structure. The space between the cathode and the anode is evacuated.

A concern with existing cathode designs is that the emitter, often a helically coiled tungsten wire filament, tends to be large and electrons are emitted radially outward from all side surfaces of the filament surface. The filaments are therefore positioned within a cup that is designed to produce a tailored electric potential distribution in the vacuum such that all electron trajectories are redirected from the initial divergent motion toward a focal spot on the anode surface. This is accomplished by way of carefully machining the cathode cup to passively shape the electric field leading to the focal spot. This often takes the form of multiple transverse slots formed in the center of the cathode cup.

The use of common machining techniques, however, tends to result in a large transverse section removed from the cup. This leaves sections of the cup with sharp features at the edges of the cup referred to as ears. These sharp features lead to high electric field stress and undesirable consequences of high voltage stability issues. In order to compensate for such sharp eared features, one approach has been to install a ring shield around the perimeter of the cup. This approach, however, introduces an increase in cost due to additional part manufacturing and an increase in complexity of the cathode assembly. A cathode cup assembly with improved design and manufacturing that eliminated the need for a separate ring shield while providing improved high voltage stability would provide for improved tailored performance of the x-ray assembly and may be used to reduce manufacturing and assembly costs.

It would, therefore, be highly desirable to have a method for manufacturing the cathode cup assembly that provided smooth cathode cup surfaces suitable for high voltage stability. Additionally, it would be highly desirable to have such a method for producing a cathode cup assembly that provided adequate shielding without requiring additional part manufacturing and assembly.

SUMMARY OF THE INVENTION

A method of producing a cathode for use in an x-ray tube assembly is provided including machining an emission aperture into a cup emission surface portion of a cup structure. The cup structure is comprised of a cup base portion opposite the cup emissions surface portion. Electro-discharge machining is used to form an electro-discharge machining slot into the cup structure to provide access to the interior of the cup structure. Electro-discharge machining is used to form a transverse coil chamber within the interior by way of the electro-discharge machining slot such that the transverse coil chamber is formed between the cup base portion and the cup emissions surface portion while retaining an essentially contiguous emissions surface perimeter surrounding the emission aperture.

Other features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
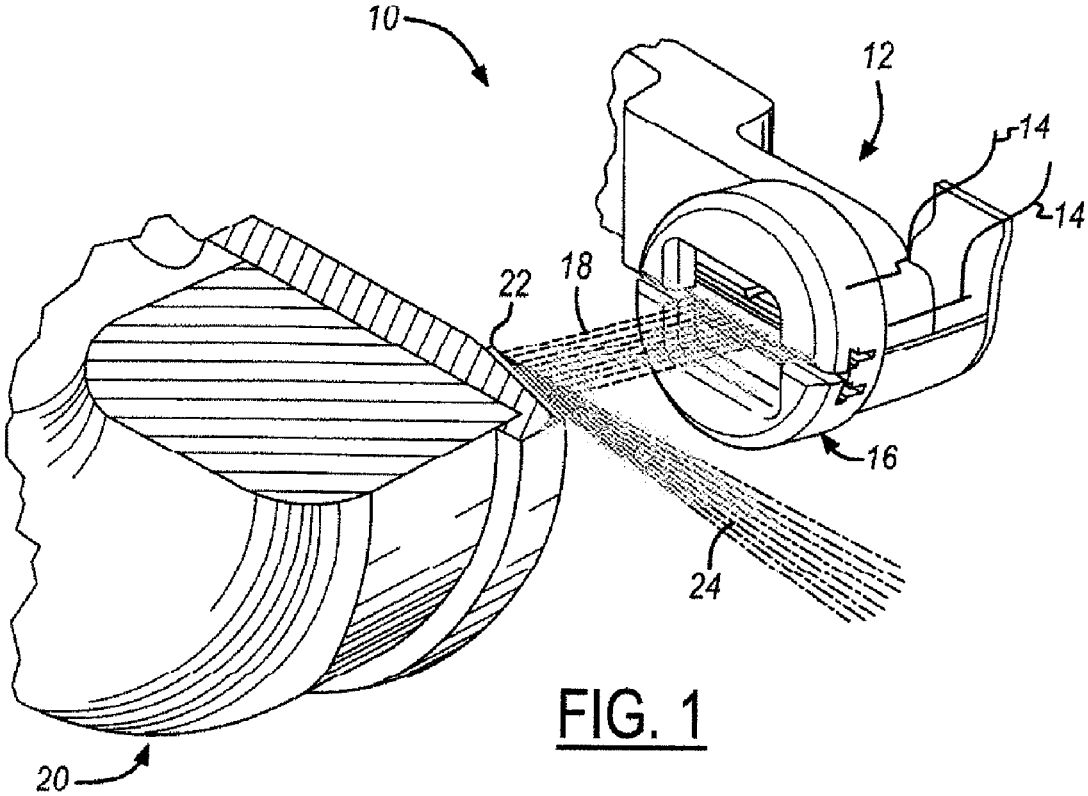
FIG. 1 is an illustration of an x-ray tube assembly in accordance with the present invention, the illustration including a cathode assembly produced using electro-discharge machining.

Referring now to FIG. 1, which is an illustration of an x-ray tube assembly 10 in accordance with the present invention. The x-ray tube assembly 10 is preferably for medical imaging applications although a variety of applications may be adapted in light of this disclosure. The x-ray tube assembly 10 includes a cathode assembly 12 having a plurality of wire filaments 14 positioned within a cup structure 16 for the generation of an electron beam 18. The beam 18 is directed towards an anode assembly 20 wherein the beam 18 impacts a target assembly 22 for the generation of x-rays 24 as is known in the art. The target assembly 24 is preferably rotated to prevent excess heat generation.

Figure 2:
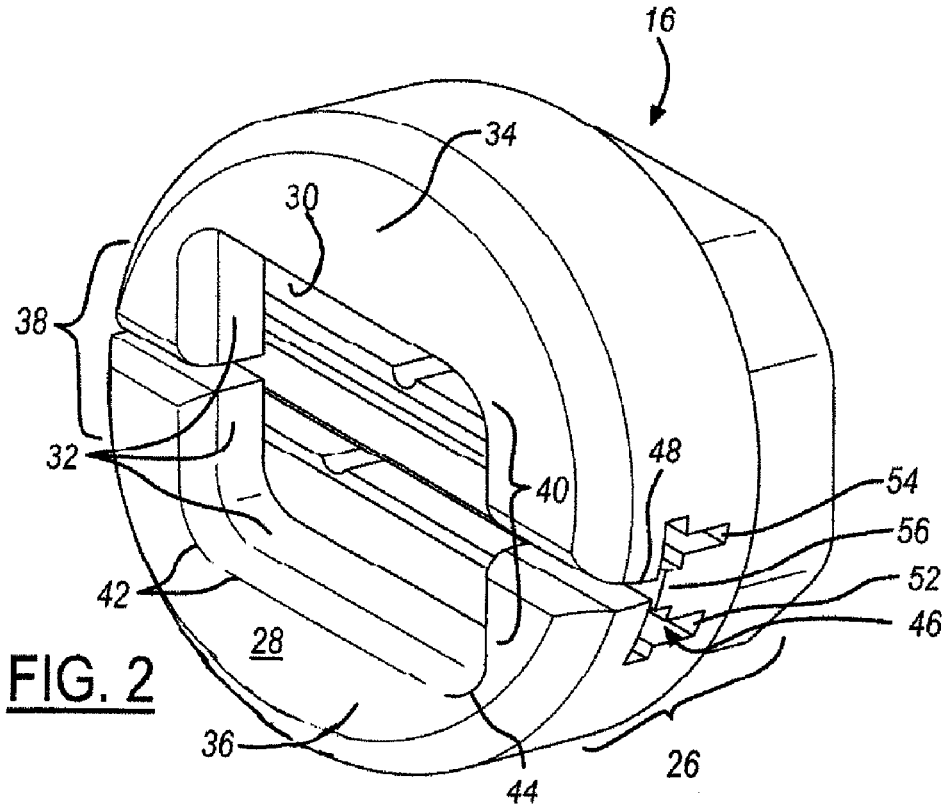
FIG. 2 is a detailed illustration of the cathode assembly illustrated in FIG. 1.

The present invention provides a unique method of producing and resultant cup structure 16 for use in the x-ray tube assembly 10 described. The cup structure 16 is comprised of a single piece cup structure 16 having a cup base portion 26 positioned below a cup emission surface portion 28 (see FIG. 2). An emission aperture 30 is machined into the cup emission surface portion 28 to form an essentially contiguous emission surface perimeter 32. The term essentially contiguous is intended to encompass the capacity to have minimal gaps in the perimeter 32 while continuing to function as a contiguous perimeter shield. The perimeter 32 is comprised of a first ear portion 34, a second ear portion 36, a first side bridge 38 and a second side bridge 40. The side bridge 38, 40 span between the ear portions 34, 36 to form the essentially contiguous surface perimeter 32. It is contemplated the emission aperture 30 may be formed in the cup emission surface portion 28 using a variety of machining techniques. The plurality of upper aperture edges 42 are preferably machined into radiused edges to form a radiused perimeter 44.

Figure 3A:
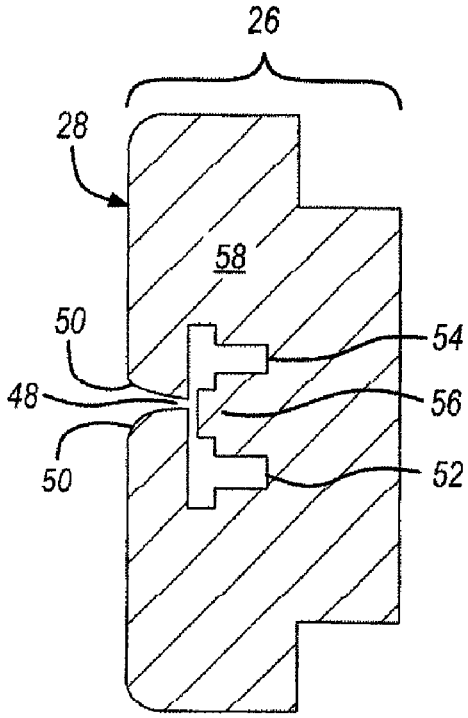
FIG. 3A is a cross-sectional illustration of the cathode assembly illustrated in FIG. 2.

The present invention forms a transverse coil chamber 46 within the cup base portion 26 below the cup emission surface portion 28 through the use of electro-discharge machining. The present invention preferably utilizes wire electro-discharge machining. Wire electro-discharge machining is an electro thermal production process in which a wire cuts through metal by the use of heat from electrical sparks. The spark is generated between the wire electrode and the metal when both are submerged in deionized water. The use of this technique is significant as it allows the machining to pass through a variety of locations in the cup structure 16 while only forming a narrow electro-discharge machining slot 48. Thus it can be passed through to form a complex and precise transverse coil chamber 46 without disrupting the essentially contiguous surface perimeter 32. In fact, in the embodiment illustrated in FIGS. 2 and 3A, the electro-discharge machining slot 48 can be passed directly through cup emission surface portion 28 without interfering with the essentially contiguous surface perimeter 32. In such an embodiment, it is contemplated that the entrance edges 50 be further machined into radiused edges to maintain high voltage stability.

Figure 3B:
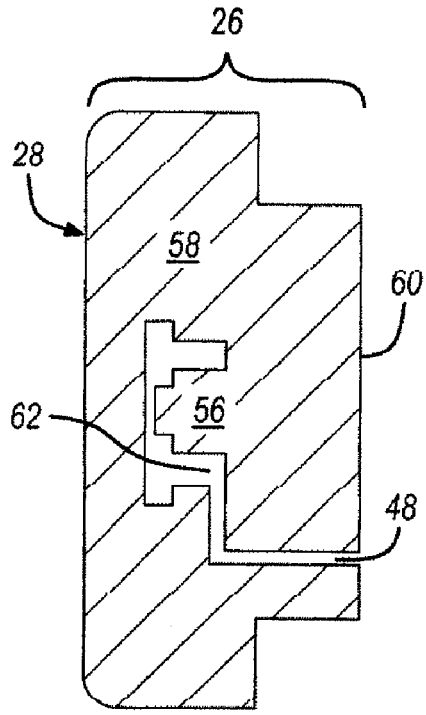
FIG. 3B is an alternate embodiment of the cathode assembly illustrated in FIG. 3A.
Figure 3C:
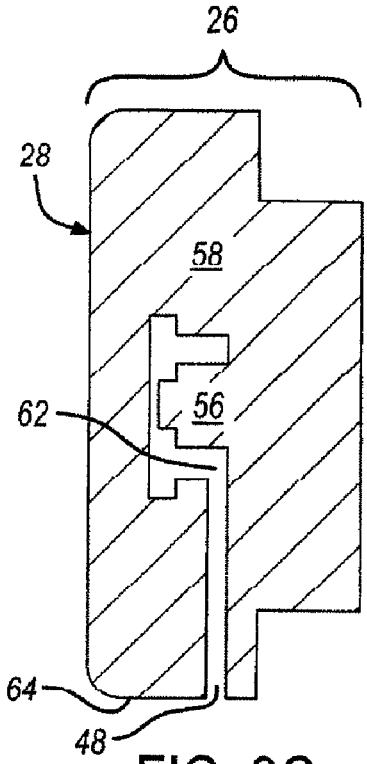
FIG. 3C is an alternate embodiment of the cathode assembly illustrated in FIG. 3A.
Figure 3D:
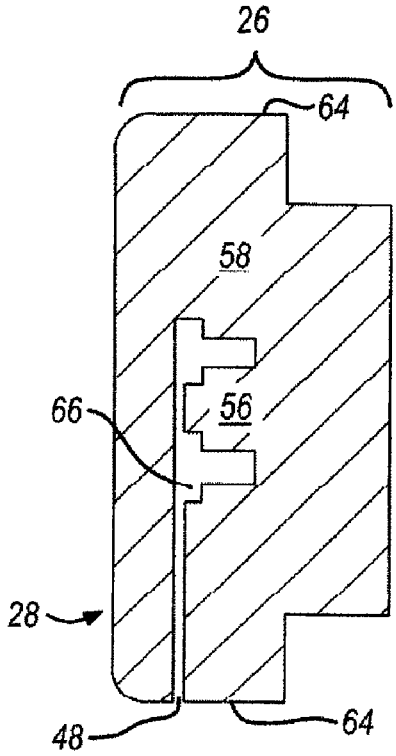
FIG. 3D is an alternate embodiment of the cathode assembly illustrated in FIG. 3A.

The transverse coil chamber 46 may be formed in a variety of fashions but is contemplated to include a large transverse coil slot 52 and a small transverse coil slot 54 formed with a separation pillar 56 positioned there between. These are formed for mounting the wire filaments 14 therein during final assembly. By routing the electro-discharge machining slot 48 through various portions of the cup structure 16 and into the interior 58 prior to formation of the transverse coil chamber 46, the cup emission surface 28 may be maintained as either completely contiguous around the perimeter 32 or essentially as previously described. The embodiments contemplated wherein that maintain complete contiguous characteristics include, but are not limited to, FIGS. 3B-3D. These include having the electro-discharge machining slot 48 enter through a rear surface 60 of the cup structure 16 and be directed towards a rearward region 62 of the transverse coil chamber 46 prior to formation (FIG. 3B). In other embodiments, the slot 48 may enter through a side surface 64 and enter either the rearward region 62 (FIG. 3C) or a forward region 66 (FIG. 3C) of the transverse coil chamber 46. Each of these embodiments integrates unique features to the resultant cup structure 16 making them tailorable to specific mounting or performance applications.

The present invention allows the bridge portions 38, 40 to be machined to arbitrary dimensions as is desired for individual designs. The machined bridge portions 38, 40 eliminates the need for separate tab elements utilized in prior art cups. Prior art designs required attachment of such tabs using manual processes. The present invention eliminates the associated complexity, cost and opportunity of failure by replacing the manual tab assembly process with a numerically controlled milling operation of the bridge portions 38, 40 of the emission aperture 30.

While particular embodiments of the invention have been shown and described, numerous variations and alternative embodiments will occur to those skilled in the art. Accordingly, it is intended that the invention be limited only in terms of the appended claims.

What is claimed is:

1. A cathode for use in an x-ray tube comprising:

a cup structure comprising:

a cup base portion;

a cup emission surface portion including an emission aperture, said cup emission surface portion including:

a first ear portion;

a second ear portion;

a first side bridge formed between said first ear portion and said second ear portion; and a second side bridge formed between said first ear portion and said second ear portion, said first ear portion, said second ear portion, said first side bridge and said second side bridge together forming an essentially contiguous emission surface perimeter surrounding said emission aperture;

a transverse coil chamber positioned within said cup base portion and below said cup emission surface portion comprising:

a large transverse coil slot;

a small transverse coil slot; and a separation pillar positioned between said large transverse coil slot and said small transverse coil slot; and in electro-discharge machining slot formed in said cup structure, said electro-discharge machining slot being separate from said transverse coil chamber and providing access to said transverse coil chamber such that said transverse coil chamber can be formed within said cup base portion and below said cup emission surface portion while maintaining said essentially contiguous emission surface perimeter;

wherein said first side bridge and said second side bridge both extend above and across a portion of said transverse coil chamber.

2. A cathode for use in an x-ray tube as described in claim 1, wherein said electro-discharge machining slot is formed in said cup emission surface portion aligned over said separation pillar.

3. A cathode for use in an x-ray tube as described in claim 1, wherein said electro-discharge machining slot is formed in a rear surface of said cup base portion, said electro-discharge machining slot entering said transverse coil chamber at a rearward region of said transverse coil chamber.

4. A cathode for use in an x-ray tube as described in claim 1, wherein said electro-discharge machining slot is formed in a side surface of said cup base portion, said electro-discharge machining slot entering said transverse coil chamber at a forward region of said transverse coil chamber.

5. A cathode for use in an x-ray tube as described in claim 1, wherein said electro-discharge machining slot is formed in a side surface of said cup base portion, said electro-discharge machining slot entering said transverse coil chamber at a rearward region of said transverse coil chamber.

6. A cathode for use in an x-ray tube as described in claim 1, wherein said emission aperture comprises:

a plurality of upper aperture edges, said plurality of upper aperture edges machined to generate a radiused perimeter.

7. A cathode for use in an x-ray tube as described in claim 2, wherein said electro-discharge machining slot comprises:

a plurality of entrance edges intersecting said cup emission surface portion, said plurality of entrance edges machined to generate radiused entrance edges.

* * * * *

UNITED STATES PATENT AND TRADEMARK OFFICE

CERTIFICATE OF CORRECTION

PATENT NO. : 7,576,481 B2
APPLICATION NO. : 11/160623
DATED : August 18, 2009
INVENTOR(S) : Sergio Lemaitre It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 609 days.

Signed and Sealed this

Seventh Day of September, 2010

David J. Kappos

David J. Kappos
*Director of the United States Patent and Trademark Office*